US011384927B2

(12) United States Patent
Béland et al.

(10) Patent No.: US 11,384,927 B2
(45) Date of Patent: Jul. 12, 2022

(54) CONDUIT ACCESS FOR LIGHT FIXTURES

(71) Applicant: AXIS LIGHTING INC., Lasalle (CA)

(72) Inventors: Stephane Béland, Lasalle (CA); Jamie Katz, Lasalle (CA); Andrew Miles, Lasalle (CA); Howard Yaphe, Lasalle (CA)

(73) Assignee: Axis Lighting Inc., LaSalle (CA)

( * ) Notice: Subject to any disclaimer, the term of this patent is extended or adjusted under 35 U.S.C. 154(b) by 992 days.

(21) Appl. No.: 15/885,742

(22) Filed: Jan. 31, 2018

(65) Prior Publication Data

US 2019/0234595 A1 Aug. 1, 2019

(51) Int. Cl.

| | |
|---|---|
| ***F21V 23/00*** | (2015.01) |
| ***F21V 21/03*** | (2006.01) |
| ***F21S 8/04*** | (2006.01) |

(52) U.S. Cl.

CPC ..... *F21V 23/002* (2013.01); *F21S 8/04* (2013.01); *F21V 21/03* (2013.01)

(58) Field of Classification Search

CPC ..... F21V 23/06; F21V 7/005
USPC ..... 362/362, 368
See application file for complete search history.

(56) References Cited

U.S. PATENT DOCUMENTS

| | | | | |
|---|---|---|---|---|
| 6,464,179 | B1 * | 10/2002 | Bulvan | H02G 3/20 248/317 |
| 6,702,453 | B2 | 3/2004 | Weedon | |
| 7,293,895 | B2 | 11/2007 | Grossman et al. | |
| 7,331,687 | B1 | 2/2008 | Noh | |
| 7,735,794 | B1 | 6/2010 | Gretz | |
| 8,128,252 | B2 | 3/2012 | Yasuda | |
| D797,988 | S | 9/2017 | Sonneman | |
| 10,309,634 | B2 | 6/2019 | Webb | |
| 10,443,823 | B2 | 10/2019 | Beland | |
| 11,092,319 | B2 | 8/2021 | Beland et al. | |
| 2009/0296381 | A1 | 12/2009 | Dubord | |

(Continued)

FOREIGN PATENT DOCUMENTS

WO WO 2017/119858 7/2017

OTHER PUBLICATIONS

Esse-Ci Srl, ISDI_DIAMANTE (To the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Apr. 2017).

(Continued)

*Primary Examiner* — William J Carter
(74) *Attorney, Agent, or Firm* — Barnes & Thornburg LLP

(57) ABSTRACT

A linear light fixture assembly comprises a linear housing structure with a linear mounting region, the linear mounting region including an exposed passage having a first lateral dimension and configured to be secured to a ceiling mounting structure on a ceiling, the ceiling mounting structure having a second lateral dimension, and a linear conduit structure having opposed surfaces which are spaced by a third lateral dimension, wherein the linear housing structure and/or the linear conduit structure are configured so that the first, second/or and third lateral dimensions enable the linear conduit structure to extend past the ceiling mounting structure into the exposed passage to deliver power to one or more light sources to be located in the housing.

15 Claims, 8 Drawing Sheets

(56) References Cited

U.S. PATENT DOCUMENTS

| | | | | |
|---|---|---|---|---|
| 2012/0182755 | A1 | 7/2012 | Wildner | |
| 2013/0050997 | A1 | 2/2013 | Bretschneider | |
| 2014/0226316 | A1* | 8/2014 | Medendorp, Jr. | F21V 21/02 362/382 |
| 2014/0362574 | A1 | 12/2014 | Barrett | |
| 2015/0009664 | A1 | 1/2015 | Liang | |
| 2015/0070882 | A1 | 3/2015 | Ohno | |
| 2015/0300605 | A1 | 10/2015 | Clark | |
| 2015/0338068 | A1 | 11/2015 | Bolscher | |
| 2015/0364853 | A1 | 12/2015 | Thijssen | |
| 2016/0245488 | A1 | 8/2016 | Clark | |
| 2017/0082253 | A1 | 3/2017 | Sorensen et al. | |
| 2018/0313503 | A1 | 11/2018 | Sonneman | |
| 2020/0217488 | A1 | 7/2020 | Beland | |

OTHER PUBLICATIONS

GES Lighting Track System, GES 1-Circuit Global Track System (To the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Jun. 2017).
Lighting Services Inc., Recessed Track Installation (2015).
Lumenalpha™ spot, 209272, lumenpulse Global Tek 100 track system installation instructions (2016).
Lytespan Track lighting 9100 (1999).
Philips, Lytespan, Basic, 1 Circuit Track 6000 (2015).
WAC Lighting, J Series 2 Circuit Track (2012).

* cited by examiner

CONDUIT ACCESS FOR LIGHT FIXTURES

REFERENCE TO CO-PENDING APPLICATIONS

The subject matters of the following co-pending applications is incorporated by reference in their entireties:

a) U.S. application filed Oct. 20, 2016 under Ser. No. 15/299,168 and entitled COUPLERS FOR LIGHT FIXTURES;

b) U.S. application filed Mar. 2, 2017 under Ser. No. 15/447,841 filed and entitled CANOPY INTERFACE FOR A CEILING MOUNT; and c) U.S. application filed concurrently with this application whose Ser. No. is not presently available and entitled MOUNT INTERFACE FOR LIGHT FIXTURES; and d) the following U.S. design applications:

1. application Ser. No. 29/623,018, filed Oct. 20, 2017 entitled LIGHT FIXTURE;
2. application Ser. No. 29/601,125, filed Apr. 19, 2017, entitled LIGHT FIXTURE; and
3. application Ser. No. 29/601,129, filed Apr. 19, 2017, entitled LIGHT FIXTURE COMPONENT USD Ser. No. 29/601,129.

FIELD OF THE DISCLOSURE

The present disclosure relates to light fixtures and associated structures.

BACKGROUND

Regardless their configuration, pendant or ceiling/wall mounted, light fixtures require a source of power, which are typically supplied a conduit network according to prevailing building codes, made by a circular cross sectioned pipe with various junctions therebetween to accommodate corners and the like, to receive and direct a power line from a power source to the light fixture. In most cases, this includes a junction box presented at or near the ceiling access point, which access is covered by an article known in the industry as a canopy.

While suitable for their intended purpose, such canopies can in some cases impose design constraints on some light fixture configurations, particularly in fixed (non-pendant) ceiling mounts.

It would thus be desirable to provide novel approaches for providing conduit access to light fixtures, or at least to provide the public with one or more useful alternatives.

SUMMARY

In an aspect, there is provided a linear light fixture assembly comprising a linear housing structure with a linear mounting region. The linear mounting region has a first lateral dimension and configured to be secured to a ceiling mounting structure on a ceiling in a flush mount configuration with an associated ceiling surface. The ceiling mounting structure has a second lateral dimension. A linear conduit structure is also provided with opposed surfaces which are spaced by a third lateral dimension to provide a conduit passage with an elongate cross section having a longitudinal axis to be aligned with at least a portion of the linear housing structure and to provide access to the linear housing structure by at least one power line located in a utility region behind the ceiling. The linear housing structure and/or the linear conduit structure are configured so that the first, second/or and third lateral dimensions enable the linear conduit structure to extend between the ceiling mounting region and the utility space and adjacent the linear mounting structure, to deliver the at least one power line to the linear housing structure for powering one or more light sources to be therein or associated therewith.

In some exemplary embodiments, a first of the outer surfaces may be configured to be adjacent a corresponding inner surface of the linear housing structure adjacent the linear mounting region and a second of the outer surfaces may be configured to be adjacent a facing edge region defined on the ceiling mounting structure. The opposed surfaces may be substantially parallel and/or substantially coplanar.

In some exemplary embodiments, the linear conduit structure may comprise first and second conduit portions, with the first and second surfaces defined on the respective first and second conduit portions.

In some exemplary embodiments, the first and second conduit portions may include respective first and second peripheries that are configured to co-engage to provide a building code compliant barrier for the conduit passage therebetween.

In some exemplary embodiments, the linear conduit structure may include a first end region that is configured to anchor the linear conduit structure relative to the linear housing structure in an operable configuration.

In an exemplary some embodiments, the linear conduit structure may include a second end region that is configured to be attachable to a junction structure.

In some exemplary embodiments, the junction structure may be coupled to the second end region in a freestanding configuration.

In another aspect, there is provided a ceiling installation comprising the light fixture assembly, at least one ceiling mounting structure and a junction structure as defined in any aspect, exemplary embodiment in the present disclosure.

In some exemplary embodiments, the second end region may include a junction passage which is shaped to receive a plurality of the at least one power line. The linear conduit structure may further comprise a transition passage between the junction passage and the conduit passage the transition passage configured to align the plurality of the at least one power line along the longitudinal axis.

In some exemplary embodiments, the junction passage may be laterally offset relative to the conduit passage.

In some exemplary embodiments, the junction passage may be circular in cross section.

In another aspect, there is provided a linear conduit structure for use in linear light fixture assembly of a type having a linear housing structure with a linear mounting region. The linear conduit structure comprises opposed surfaces that are spaced by a lateral dimension to provide a conduit passage with an elongate cross section having a longitudinal axis to be aligned with at least a portion of the linear housing structure and to provide access to the linear housing structure by at least one power line located in a utility region behind the ceiling.

In another aspect, there is provided a linear light fixture assembly comprising a linear housing structure with a linear mounting region. The linear mounting region includes an exposed passage having a first lateral dimension and configured to be secured to a ceiling mounting structure on a grid ceiling and which has a second lateral dimension. Also provided is a linear conduit structure having opposed surfaces that are spaced by a third lateral dimension. The linear housing structure and/or the linear conduit structure are configured so that the first, second/or and third lateral dimensions enable the linear conduit structure to extend past the ceiling mounting structure into the exposed passage to deliver power to one or more light sources to be located in the housing.

BRIEF DESCRIPTION OF THE FIGURES

Several exemplary embodiments of the present disclosure will be provided, by way of examples only, with reference to the appended drawings, wherein:

FIGS. 10 and 11 are perspective views of a portion of the light fixture of FIG. 1, while

DETAILED DESCRIPTION

Figure 1:
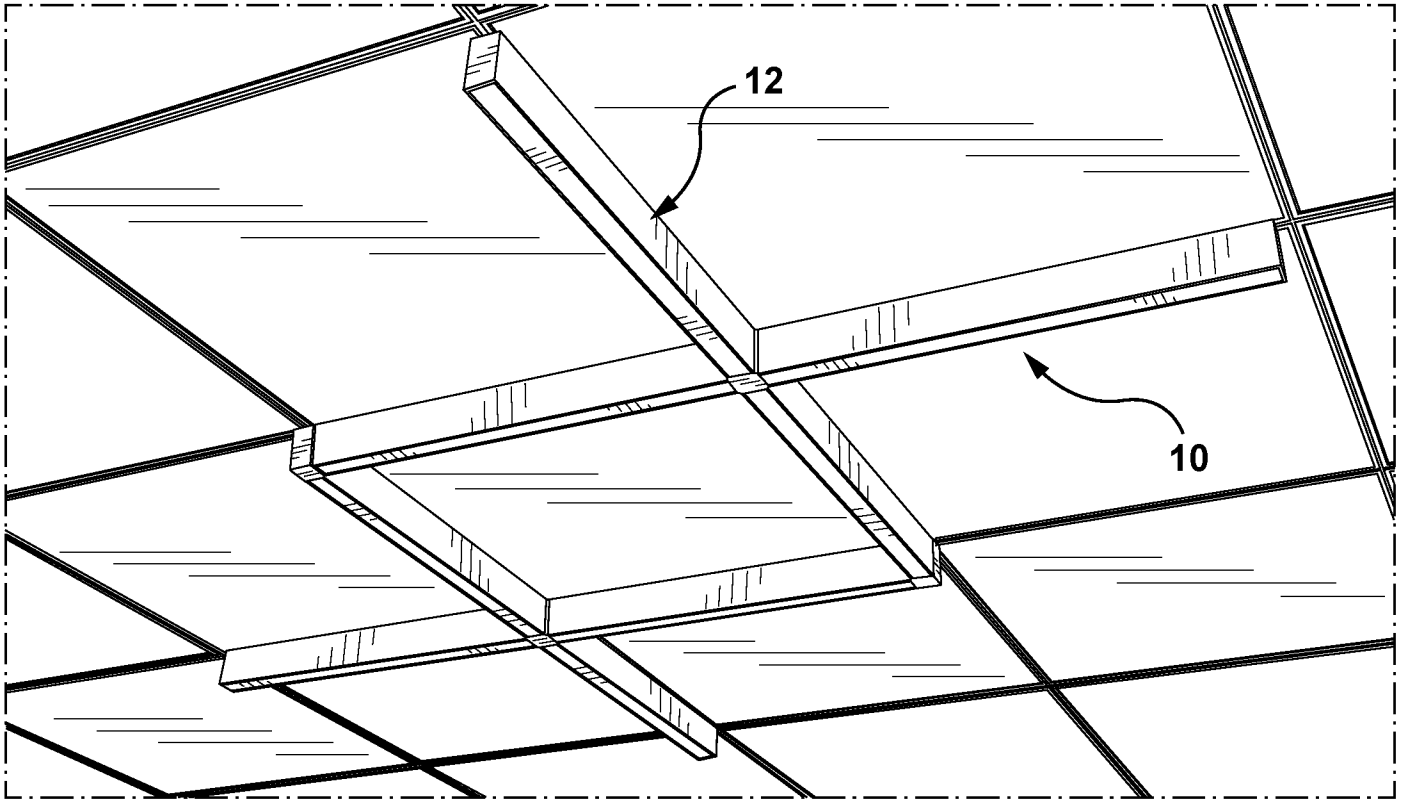
FIG. 1 is a perspective view of a light fixture assembly in an operative configuration.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical, mechanical or other connections or couplings. The terms upper, lower, and vertical are intended for operative context only and are not necessarily intended to limit the invention only to those configurations or orientations. Furthermore, and as described in subsequent paragraphs, the specific mechanical and/or other configurations illustrated in the drawings are intended to exemplify embodiments of the invention. However, other alternative mechanical and/or other configurations are possible which are considered to be within the teachings of the instant disclosure.

The term "flush mount" is intended to mean a mount for a light fixture on a ceiling, with little to no gap between the light fixture and the ceiling.

Figure 2:
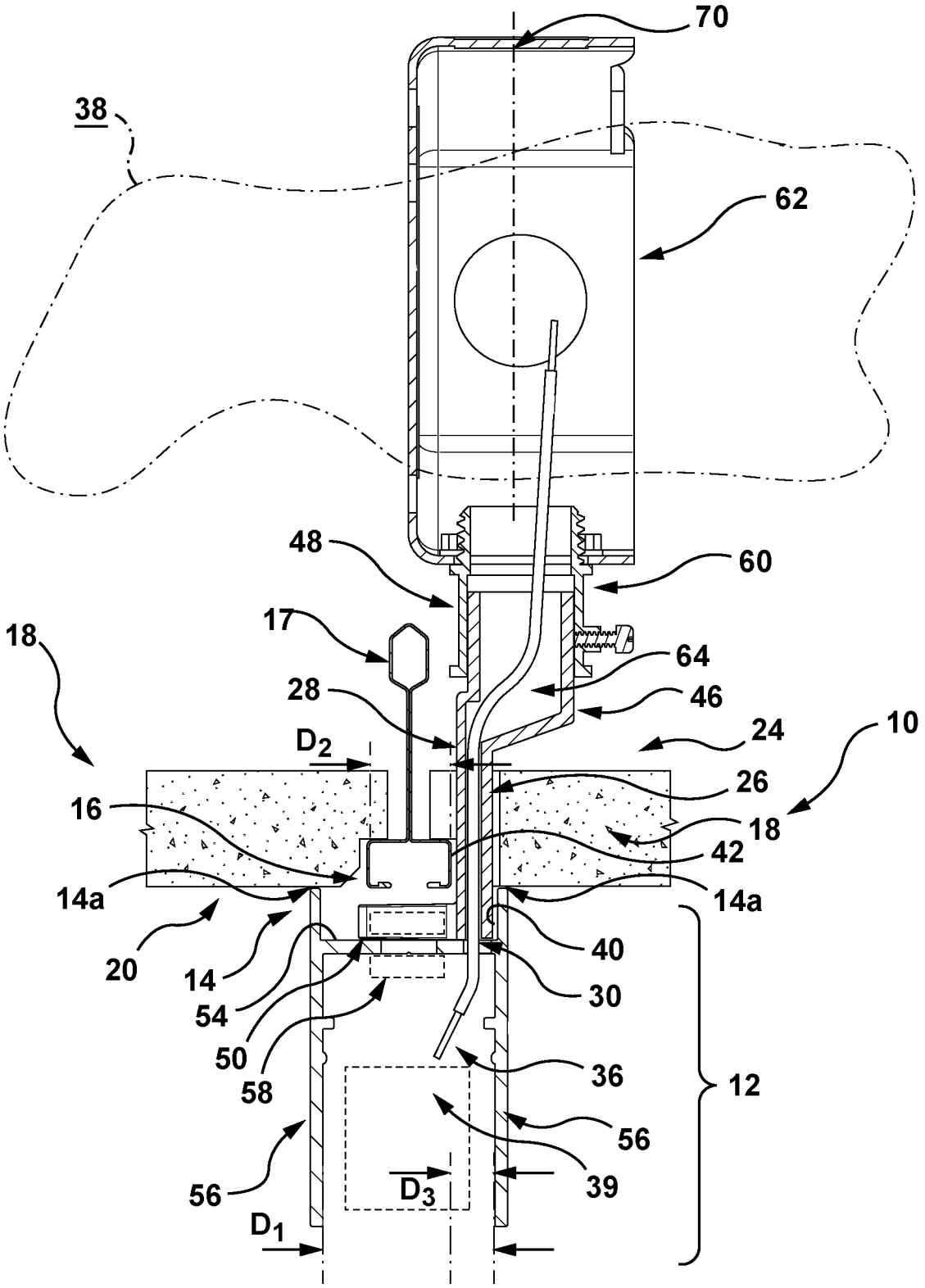
FIG. 2 is a fragmentary sectional view of a segment of the light fixture assembly of FIG. 1.

Referring to the FIG. 1, there is provided an exemplary embodiment of a linear light fixture assembly 10 comprising a number of linear housing structures 12 in a rectangular patterned configuration, as one of a number of such configurations available using the coupler as disclosed in co-pending U.S. application Ser. No. 15/299,168. Referring to FIG. 2, the linear housing structure 12 has a linear mounting 14 region with a first lateral dimension D1 and is configured to be secured to a ceiling mounting structure 16 on a ceiling 18 in a flush mount configuration with an associated ceiling surface 20. In this case, the ceiling mounting structure 16 is provided in the form of a suspension structure, shown as a t-bar-shaped portion or t-bar 17 as part of t-bar grid, having a second lateral dimension D2, though other ceiling grid elements and configurations may be used as desired.

Figure 3:
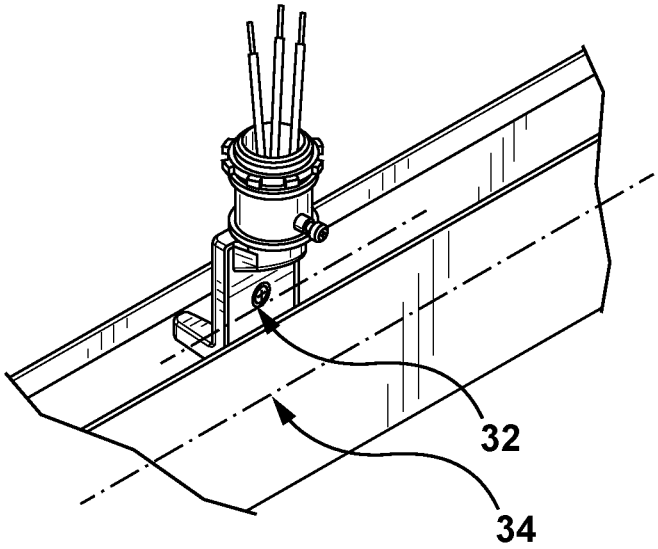
FIGS. 3 to 9 are fragmentary perspective views of portions of the light fixture assembly of FIG. 1 or variations thereof.

A linear conduit structure is also provided, as generally shown at 24 in FIG. 2, which has substantially parallel opposed surfaces 26, 28 that are spaced by a third lateral dimension D3. The linear conduit structure 24 provides a conduit passage 30 with a relatively narrow (as shown in FIG. 2) and elongate cross section with a longitudinal axis 32 (FIG. 3) which is aligned with a corresponding longitudinal axis 34 of at least a portion of the linear housing structure 12. The linear conduit structure 24 is configured to provide access to the linear housing structure 12 by at least one power line 36 located in a utility region behind the ceiling, as generally shown at 38. It should be noted that the term "power line" is used herein to describe the item that has a portion contained in the conduit, but it should be understood that this term should be broadly defined to include any item that has a portion contained in the conduit. In this regard, the power line could be a data line, conductive wires, optical media, or any other similar power, data or other media-carrying item currently known or hereafter conceived. The conduit, while having utility in the present lighting embodiment, could be employed in a "drop" to deliver a "line" from the ceiling area to any area below the ceiling and shielding this line in the passage through the ceiling.

Thus, the linear housing structure 12 and/or the linear conduit structure 24 are configured so that the first, second/or and third lateral dimensions D1, D2 and D3 enable the linear conduit structure 24 to extend between the linear mounting region 14 and the utility region 38 and adjacent the ceiling mounting structure 16, to deliver the at least one power line 36 to the linear housing structure 12 for powering one or more light sources shown schematically at 39 therein or associated therewith.

In some exemplary embodiments, a first of the outer surfaces 26 is configured to be adjacent a corresponding inner surface 40 of the linear housing structure 12 adjacent the linear mounting region 14 and a second of the surfaces 28 is configured to be adjacent an outer edge region 42 defined on the lower region of the t-bar portion 17 as viewed in FIG. 2.

Figure 4:
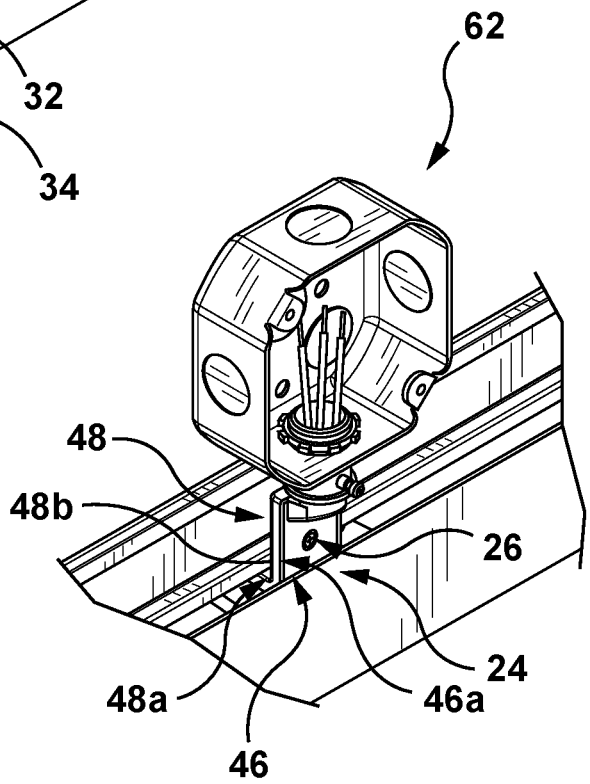

In some exemplary embodiments, as shown in FIG. 4, the linear conduit structure 24 further comprises first and second conduit portions 46, 48, with the first and second surfaces 26, 28 defined on respective ones thereof.

Figure 12:
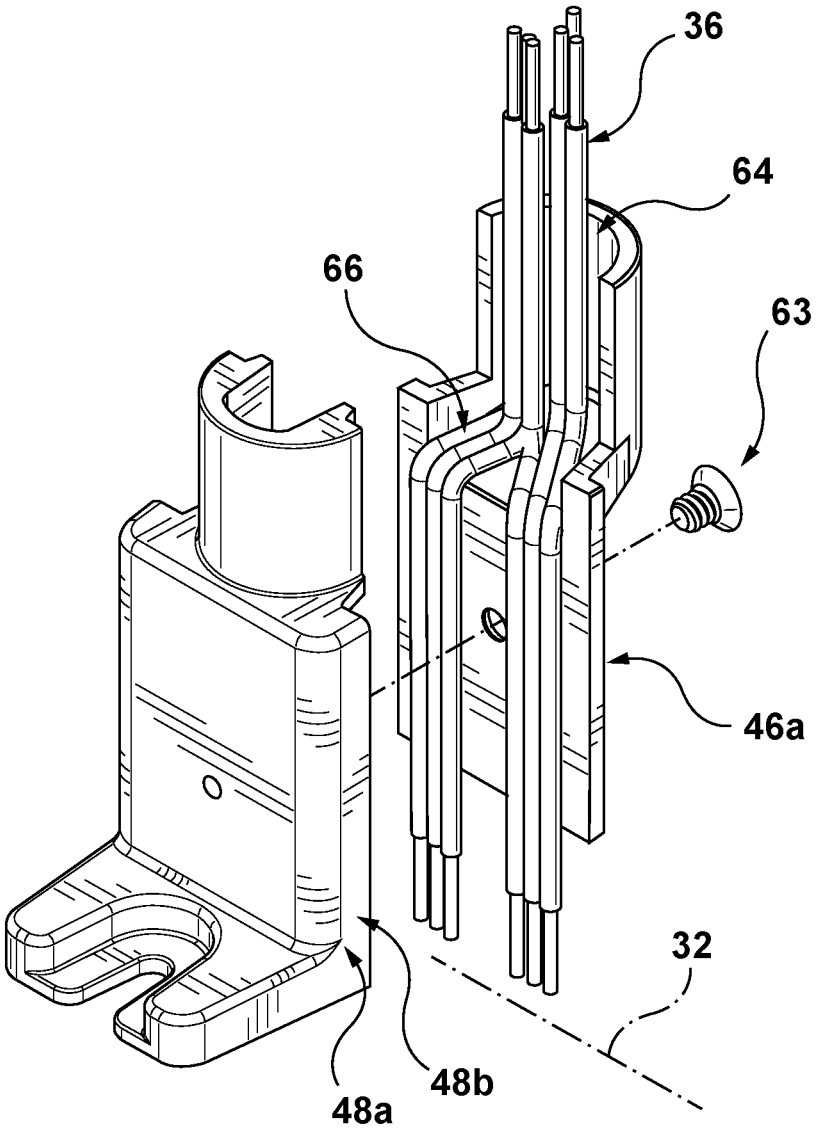
FIGS. 12 and 13 are exploded views thereof.
Figure 13:
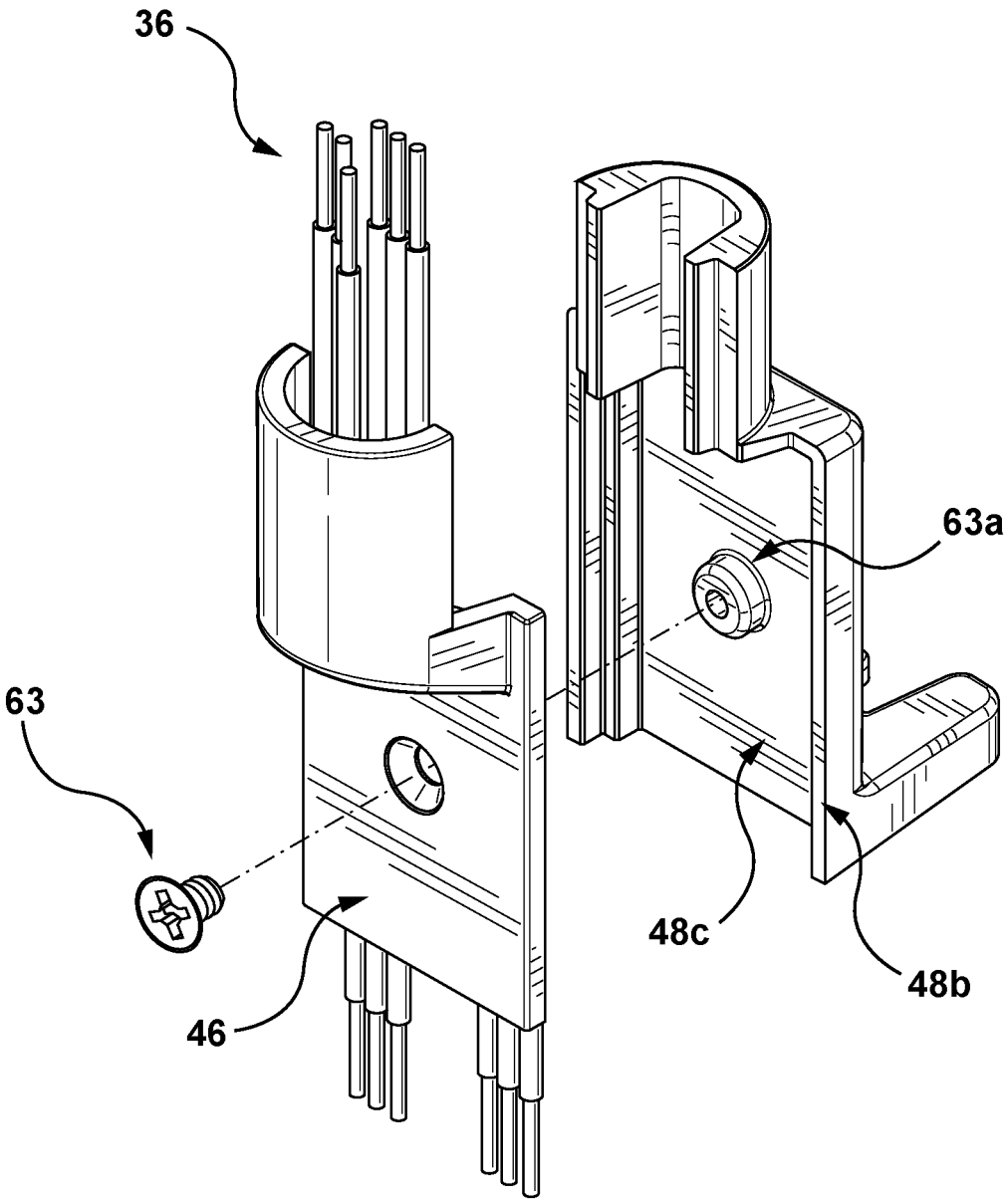

In some exemplary embodiments, as shown in FIGS. 6 to 9, the first and second conduit portions 46, 48 include respective first and second peripheries 46*a*, 48*a* that are configured to co-engage to provide a building code compliant barrier or shield for the relatively narrow elongate conduit passage 30 therebetween. In this example, the second peripheries 48*a* each include an outwardly extending flange 48*b* which form a recess 48c therebetween to receive the first conduit portion 46. The first and second conduit portions 46, 48 may be joined by fastener 63 and threaded boss 63a (FIGS. 12, 13).

As can be seen in FIG. 2, the degree to which the conduit passage 30 is relatively narrow, in this instance, may be designated in part by the thickness of the one or more power lines 36 to be contained therein, which may be in a side by side orientation therein, and thus may approximate a dimension relatively larger than a single power line, while remaining sufficiently narrow in relation to respective dimensions as discussed below, to reduce the lateral dimension of the linear conduit structure 24.

Thus, in some exemplary embodiment, the second end region may be configured to support the junction structure in a freestanding configuration. Further, the second end region may include a junction passage (as shown at 64 in FIGS. 2, 10 and 12) which is shaped to receive a plurality of the at least one power line. In this case, a transition passage 66 extends between the junction passage 64 and the conduit passage 30, and is configured to align, while shielding, the plurality of the at least one power line along the longitudinal axis 32. The junction passage may be circular (or other shape) in cross section to receive a bundle of power lines in a circular (or other shape) cable cross section or configuration. Further, the laterally may be offset relative to the conduit passage to accommodate both the circular cross-sectioned space of the junction passage 64. In effect, the lateral offset shifts a central axis 70 (FIG. 2) of the junction passage 64 toward the right hand side panel 18 as shown in FIG. 2 so that the junction structure can accommodate, and/or minimize interference with, t-bar grid and its supporting infrastructure.

In some exemplary embodiments, the narrower the dimension D3 of the linear conduit structure 24, the narrower the dimension D1 of the linear housing structure 12 can be, to provide the linear conduit structure 24 sufficient access to the linear housing structure 12 while accommodating the lateral dimension D2 of the t-bar portion 17. This may provide considerable design advantages, for example to achieve a flush mount configuration with a correspondingly thin-profiled linear housing structure 12 on the ceiling surface 20, with power directed to the former via the linear conduit structure 24. In some instances, where canopies may be considered undesirable, the use of the linear conduit structure 24 thus may achieve a thin-profiled flush mounted linear light fixture configuration without the need for (or the design limitations imposed by) a canopy, an example of which is disclosed in the above referenced U.S. application Ser. No. 15/447,841.

In other instances, there may be benefits to incorporating a linear conduit structure according to exemplary embodiments herein with a canopy, while the possible incorporated use thereof together should not detract from the benefits of the linear conduit structure in the noted flush mount configuration, without requiring a canopy.

Figure 10:
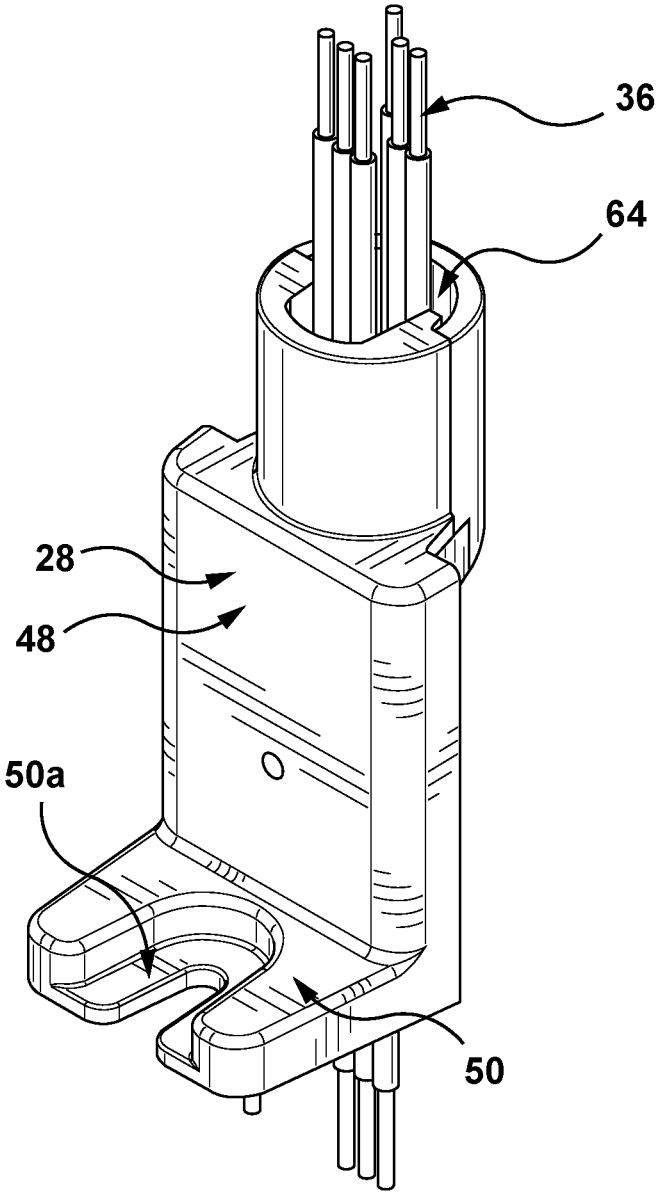
Figure 11:
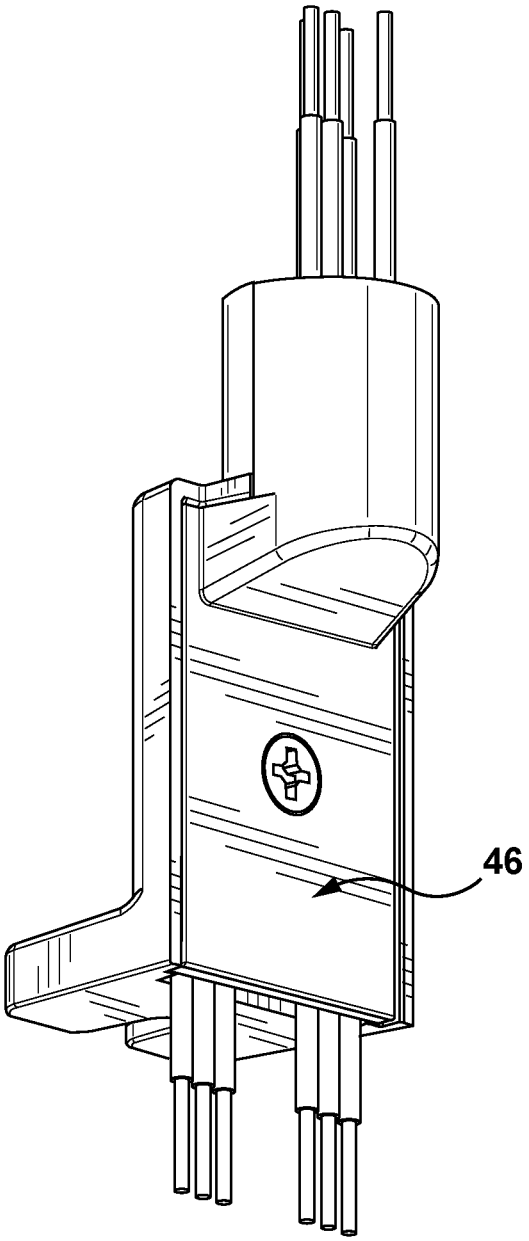

In some exemplary embodiments, the linear conduit structure 24 includes a first end region 50 which is configured to be attached to the linear housing structure 12, by way of recessed region 50*a* (FIG. 10). The first end region 50 may extend laterally from the surface 28 toward and adjacent an inner frame portion 54 (extending between boundary portions 56) and be secured thereto by way of a fastener shown schematically at 58. Alternatively, the first end region may be secured to other locations on the linear housing structure 12 or on ceiling mounting structure 16.

Figure 5:
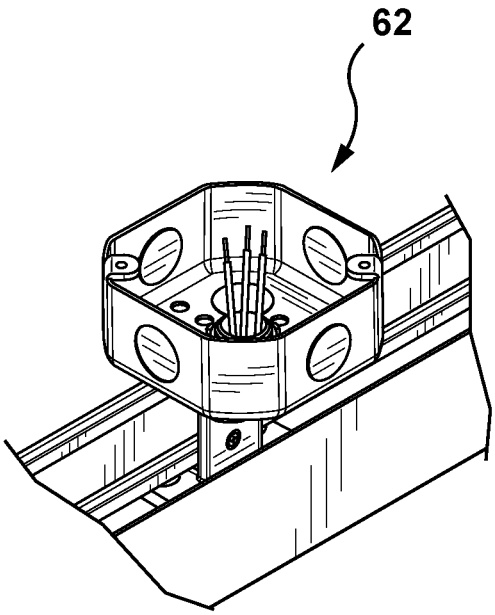

In some exemplary embodiments, the linear conduit structure 24 may further comprise a second end region 60 which is configured to engage a junction structure 62, and in a form of coupling to enable the junction structure 62 to be in a freestanding configuration, in different possible positions as shown for example in FIGS. 4 and 5.

Figure 6:
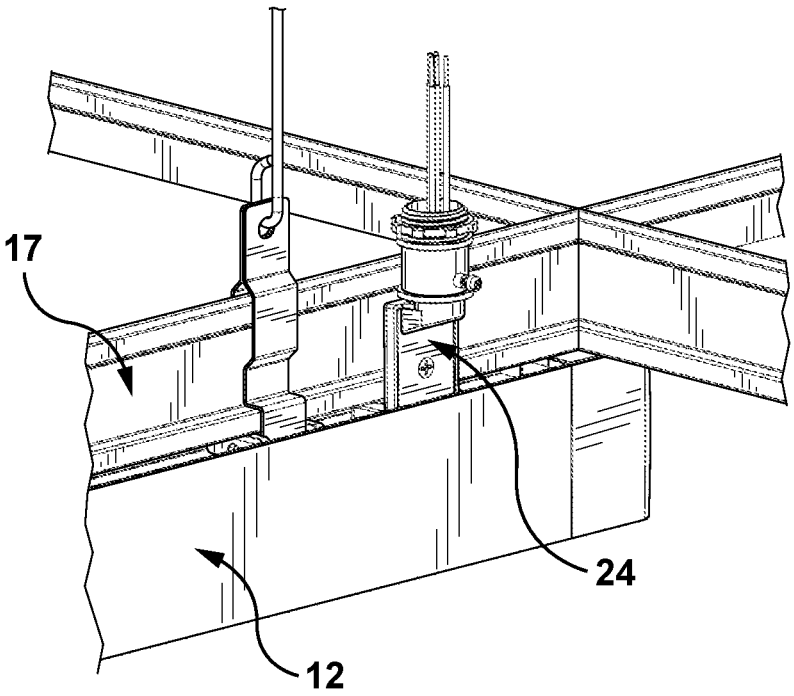
Figure 7:
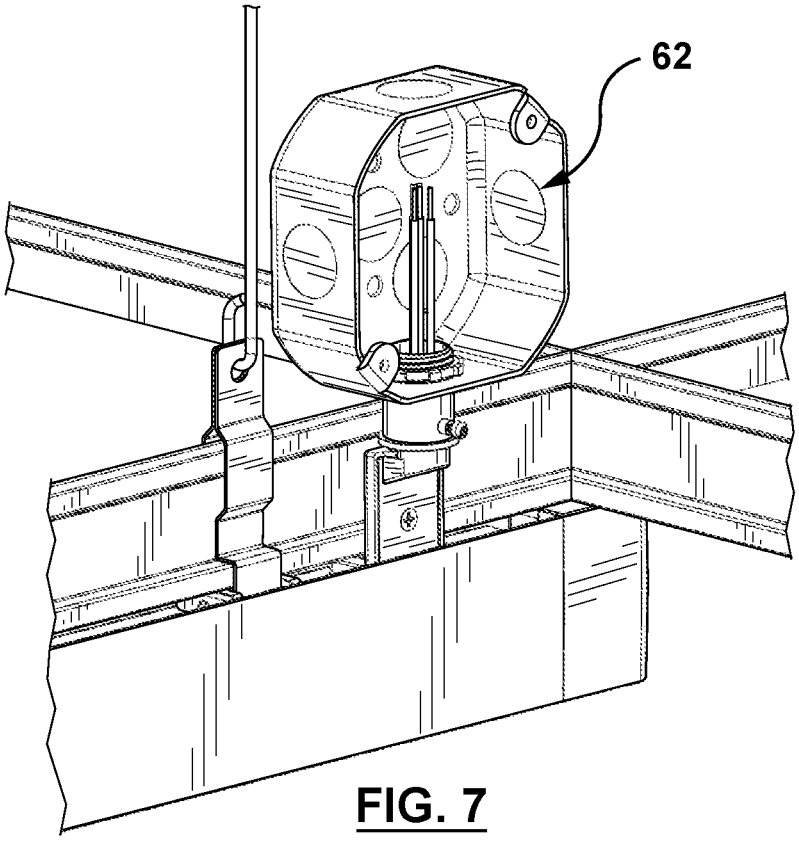
Figure 8:
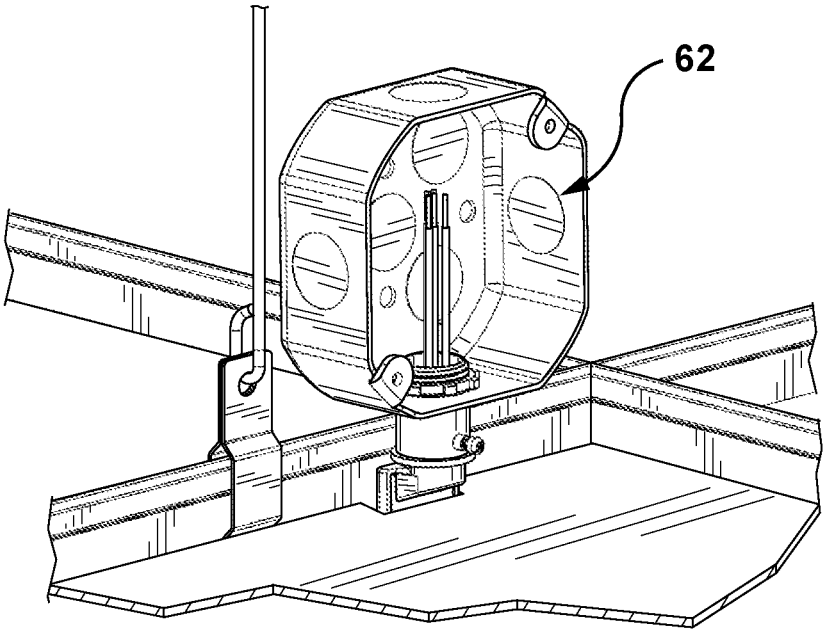
Figure 9:
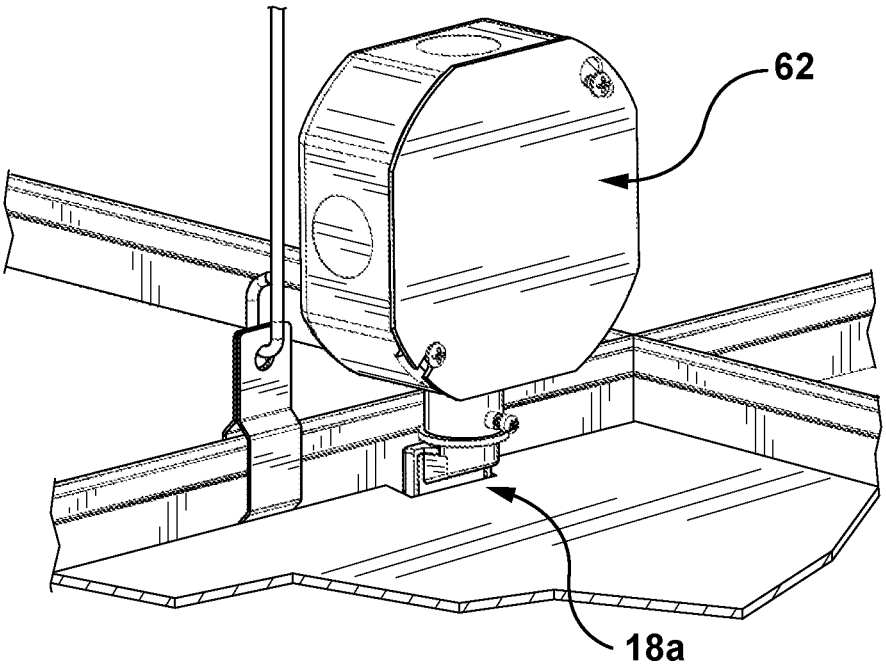

FIGS. 6 to 8 illustrate, in part, progressive illustrations of the installation of power to an installed light fixture incorporating the linear fixture housing 12 which positioned immediately below a t-bar portion 17 and anchored thereto by way of the structure and method disclosed in co-pending U.S. application identified in paragraph [0001] under c) and entitled MOUNT INTERFACE FOR LIGHT FIXTURES. FIG. 6 shows the linear conduit structure 24 fixed to the linear housing structure 12, while FIG. 7 shows the junction structure 62 fastened to the linear conduit structure 24. In FIG. 8, the ceiling 18 is installed with a notch 18*a* formed therein to accommodate the linear conduit structure 24 and FIG. 9 shows the junction structure 62 capped to complete installation.

Thus, in some exemplary embodiments, the use of the linear conduit structure as provided in the present disclosure may be integrated in function with the mounting assembly as disclosed in U.S. application filed concurrently with this application whose serial number is not presently available and entitled MOUNT INTERFACE FOR LIGHT FIXTURES, as identified in c) of paragraph [0001] above, for example by providing a particular benefit of allowing edge regions of a linear light fixture housing to be positioned directly against a ceiling surface, in a manner that conceals the mounting assembly, that is with no features of the mounting assembly visible beyond the light fixture housing. Further, the mounting assembly establishes localized suspensions between anchor and target locations on the ceiling and the light fixture, along the corresponding arrays thereof.

In some exemplary embodiments, other features and structures may be integrated into the light fixture or between the light fixture and the ceiling, such as the conduit structure described herein. Thus, the access for power and the mounting of the light fixture may be provided with separate structures, enabling both to be determined by independent factors. Thus, the target locations may be determined based on design criteria, while the conduit location(s) may be chosen for the same or other criteria, such as the availability or proximity of the power supply relative to different locations on the light fixture.

Further, in some exemplary embodiments, the mounting assembly and the linear conduit structure may be used to provide protection for the supply of power without being exposed to the exterior or entrained in the mounting assembly. For instance, the light source 39 may be provided in module form integrating power supply delivery to individual LED's in an enclosed LED array, as well as providing optics for the linear light fixture assembly.

While the present disclosure describes various exemplary embodiments, the disclosure is not so limited. To the contrary, the disclosure is intended to cover various modifications and equivalent arrangements, as will be readily appreciated by the person of ordinary skill in the art.

The invention claimed is:

1. A linear light fixture assembly comprising at least one linear housing structure with a linear mounting region, the linear mounting region having a first lateral dimension and configured to be secured to a ceiling mounting structure on a ceiling in a flush mount configuration with an associated ceiling surface, the ceiling mounting structure having a second lateral dimension, and a linear conduit structure having opposed surfaces which are spaced by a third lateral dimension to provide a conduit passage, with an elongate cross section having a longitudinal axis to be aligned with at least a portion of the linear housing structure and to provide access to the linear housing structure by at least one power line located in a utility region behind the ceiling, wherein the linear housing structure and/or the linear conduit structure are configured so that the first, second and/or third lateral dimensions enable the linear conduit structure to extend between the linear mounting region and the utility region and adjacent the ceiling mounting structure, to deliver the at least one power line to the linear housing structure for powering one or more light sources to be therein or associated therewith, wherein a first of the opposed surfaces is configured to be adjacent a corresponding inner surface of the linear housing structure adjacent the linear mounting region and a second of the opposed surfaces is configured to be adjacent a facing edge region defined on the ceiling mounting structure; wherein the linear conduit structure comprises first and second conduit portions, with the opposed surfaces defined on the respective first and second conduit portions; the linear conduit structure includes a first end region which is configured to anchor the linear conduit structure relative to the linear housing structure in an operable configuration;

and the linear conduit structure includes a second end region that is configured to solely support a junction structure in the utility region behind the ceiling.

2. An assembly as defined in claim 1, wherein the first and second conduit portions include respective first and second peripheries which are configured to co-engage to provide a building code compliant barrier for the conduit passage therebetween.

3. An assembly as defined in claim 1, wherein the junction structure is coupled to the second end region in a freestanding configuration.

4. An assembly as defined in claim 1, wherein the second end region includes a junction passage which is shaped to receive a plurality of the at least one power line, the linear conduit structure further comprising a transition passage between the junction passage and the conduit passage the transition passage configured to align the plurality of the at least one power line along the longitudinal axis.

5. An assembly as defined in claim 4, wherein the junction passage is laterally offset relative to the conduit passage.

6. An assembly as defined in claim 5, wherein the junction passage is circular in cross section.

7. A ceiling installation comprising the light fixture assembly, at least one ceiling mounting structure and a linear conduit structure of claim 1 in an operative condition.

8. A linear conduit structure for use in a linear light fixture assembly of a type having a linear housing structure with a linear mounting region for mounting on a ceiling, the linear conduit structure comprising opposed surfaces that are spaced by a lateral dimension to provide a conduit passage with an elongate cross section having a longitudinal axis to be aligned with at least a portion of the linear housing structure and to provide access to the linear housing structure by at least one power line located in a utility region behind the ceiling, wherein a first of the opposed surfaces is configured to be adjacent a corresponding inner surface of the linear housing structure adjacent the linear mounting region and a second of the opposed surfaces is configured to be adjacent a facing edge region defined on a ceiling mounting structure on the ceiling; wherein the linear conduit structure comprises first and second conduit portions, with the opposed surfaces defined on the respective first and second conduit portions; the linear conduit structure includes a first end region which is configured to anchor the linear conduit structure relative to the linear housing structure in an operable configuration; and the linear conduit structure includes a second end region that is configured to solely support a junction structure in the utility region behind the ceiling.

9. A structure as defined in claim 8, wherein the linear conduit structure comprises first and second conduit portions, with the opposed surfaces defined on the respective first and second conduit portions, respectively.

10. A structure as defined in claim 9, wherein the first and second conduit portions include respective first and second peripheries that are configured to co-engage to provide a building code compliant barrier for a conduit passage.

11. A structure as defined in claim 8, wherein the second end region is configured to support the junction structure in a freestanding configuration.

12. A structure as defined in claim 11, wherein the second end region includes a junction passage which is shaped to receive a plurality of the at least one power line, the linear conduit structure further comprising a transition passage between the junction passage and the conduit passage the transition passage configured to align the plurality of the at least one power line along the longitudinal axis.

13. A structure as defined in claim 12, wherein the junction passage is laterally offset relative to the conduit passage.

14. A structure as defined in claim 13, wherein the junction passage is circular in cross section.

15. A linear light fixture assembly comprising a linear housing structure with a linear mounting region, the linear mounting region including an exposed passage having a first lateral dimension and configured to be secured to a ceiling mounting structure on a ceiling, the ceiling mounting structure having a second lateral dimension, and a linear conduit structure having opposed surfaces which are spaced by a third lateral dimension, wherein the linear housing structure and/or the linear conduit structure are configured so that the first, second and/or third lateral dimensions enable the linear conduit structure to extend past the ceiling mounting structure into the exposed passage to deliver power to one or more light sources to be located in the housing, wherein a first of the opposed surfaces is configured to be adjacent a corresponding inner surface of the linear housing structure adjacent the linear mounting region and a second of the outer surfaces is configured to be adjacent a facing edge region defined on the ceiling mounting structure; wherein the linear conduit structure comprises first and second conduit portions, with the opposed surfaces defined on the respective first and second conduit portions; the linear conduit structure includes a first end region which is configured to anchor the linear conduit structure relative to the linear housing structure in an operable configuration; and the linear conduit structure includes a second end region that is configured to solely support a junction structure in the utility region behind the ceiling.

* * * * *